US010850894B2

(12) United States Patent
Vredevoogd

(10) Patent No.: US 10,850,894 B2
(45) Date of Patent: Dec. 1, 2020

(54) DISPENSING SYSTEM, SPOUT AND SQUEEZABLE CONTAINER

(71) Applicant: FRONTWAVE B.V., Amsterdam (NL)

(72) Inventor: Tammo Vredevoogd, Amsterdam (NL)

(73) Assignee: FW Dispensing B.V., Amsterdam (NL)

( * ) Notice: Subject to any disclaimer, the term of this patent is extended or adjusted under 35 U.S.C. 154(b) by 0 days.

(21) Appl. No.: 16/306,662

(22) PCT Filed: Jun. 1, 2017

(86) PCT No.: PCT/EP2017/063358
§ 371 (c)(1),
(2) Date: Dec. 3, 2018

(87) PCT Pub. No.: WO2017/207710
PCT Pub. Date: Dec. 7, 2017

(65) Prior Publication Data

US 2019/0218001 A1 Jul. 18, 2019

(30) Foreign Application Priority Data

Jun. 2, 2016 (EP) ..... 16172613
Jan. 31, 2017 (EP) ..... 17153958
Mar. 24, 2017 (EP) ..... 17162885

(51) Int. Cl.
*B65D 47/06* (2006.01)
*B65D 47/20* (2006.01)
(Continued)

(52) U.S. Cl.
CPC ..... *B65D 47/065* (2013.01); *B65D 47/0804* (2013.01); *B65D 47/2031* (2013.01); *B65D 83/0055* (2013.01)

(58) Field of Classification Search
CPC ..... B65D 47/065; B65D 47/0804; B65D 47/2031; B65D 83/0055
(Continued)

(56) References Cited

U.S. PATENT DOCUMENTS 2,550,132 A * 4/1951 Woods ..... B65D 47/2031 222/490
2,758,755 A 8/1956 Schafler
(Continued)

FOREIGN PATENT DOCUMENTS

CN 102320413 A 1/2012
EP 0023396 A 2/1981
(Continued)

OTHER PUBLICATIONS

PCT International Search Report issued for international application No. PCT/EP2017/063358 by the European Patent Office dated Sep. 11, 2017.
(Continued)

*Primary Examiner* — Donnell A Long
(74) *Attorney, Agent, or Firm* — Hoyng Rokh Monegier LLP; David P. Owen

(57) ABSTRACT

The present invention relates to a dispensing system for a squeezable container that can contain a fluid. The dispensing system comprises a housing with a fluid receiving space, a spout with spout opening through which fluid can be dispensed and biasing means for biasing the spout opening to a state wherein fluid dispensing is blocked; wherein the spout is flexible and wherein the spout opening can move with respect to the housing.

20 Claims, 9 Drawing Sheets

(51) Int. Cl.
*B65D 47/08* (2006.01)
*B65D 83/00* (2006.01)

(58) Field of Classification Search
USPC ..... 222/494, 211–215, 94–96, 105, 107, 222/481.5
See application file for complete search history.

(56) References Cited

U.S. PATENT DOCUMENTS

| | | | | |
|---|---|---|---|---|
| 5,687,861 | A | 11/1997 | Wiedemann | |
| 5,774,141 | A | 6/1998 | Cooper et al. | |
| 5,902,060 | A * | 5/1999 | Rodriguez | A45D 26/0014 220/784 |
| 6,457,613 | B1 * | 10/2002 | Patterson | B65D 47/10 137/493.8 |
| 8,016,507 | B2 * | 9/2011 | Wright | A45D 34/00 401/266 |
| 2003/0132240 | A1 * | 7/2003 | Gueret | A45D 33/006 222/1 |
| 2003/0189067 | A1 * | 10/2003 | Stull | B65D 47/2031 222/494 |
| 2005/0135869 | A1 | 6/2005 | Liberatore | |
| 2006/0226171 | A1 * | 10/2006 | Sternberg | B65D 83/0055 222/95 |
| 2008/0110938 | A1 * | 5/2008 | Sternberg | B65D 47/2031 222/494 |
| 2008/0253797 | A1 | 10/2008 | Sakagami | |
| 2009/0278883 | A1 | 11/2009 | Rawlings et al. | |
| 2012/0007916 | A1 | 1/2012 | Kumagai | |
| 2012/0062679 | A1 | 3/2012 | Yokota | |
| 2012/0305602 | A1 * | 12/2012 | Kneer | B65D 47/2068 222/95 |
| 2015/0053726 | A1 * | 2/2015 | Heipp | B65D 47/2031 222/494 |
| 2015/0085014 | A1 | 3/2015 | Ishida et al. | |
| 2015/0124034 | A1 | 5/2015 | Shinoda et al. | |
| 2015/0336721 | A1 | 11/2015 | Lu et al. | |

FOREIGN PATENT DOCUMENTS

| | | | |
|---|---|---|---|
| EP | 2035287 | A2 | 3/2009 |
| EP | 2123465 | A1 | 11/2009 |
| EP | 2774871 | A1 | 9/2014 |
| EP | 2857209 | A1 | 4/2015 |
| JP | 2004256299 | A | 9/2004 |
| WO | 2010027365 | A1 | 3/2010 |
| WO | 2012027768 | A1 | 3/2012 |
| WO | 2013137443 | A1 | 9/2013 |

OTHER PUBLICATIONS

WIPO PCT Invitation Informal Clarification Aug. 16, 2017 issued for international application No. PCT/EP2017/063358 with European Search Report dated Jul. 6, 2017.

* cited by examiner

DISPENSING SYSTEM, SPOUT AND SQUEEZABLE CONTAINER

The current invention relates to a dispensing system for a squeezable container, in particular for applying the dispensed fluid. The current invention also relates to a squeezable container having a dispensing system. The invention relates to a spout for a dispensing system. Further the invention relates to a method of manufacturing a spout, dispensing system and/or a squeezable container having the dispensing system.

A fluid can be held in the squeezable container. Squeezable containers have been used for a long time. They are easy to use and can be manufactured at low costs. A substance can be dispensed from the container to be applied to a surface, such as onto the body of the user. The dispensing end can come in contact with the surface.

Squeezable containers have a couple of disadvantages. If the discharge opening is open, air can enter and the content of the container can deteriorate. Dispensing dosed amounts can be difficult. Product can clock the discharge end, if not cleaned. Product can leak from the container if not properly closed. After dispensing fluid from the system, less fluid is held in the container. With less fluid being held in the container, sputtering during dispensing can occur. Product can stick to the dispensing end, hindering application of the product to a surface.

It would be desirable to provide an improved dispensing system for a squeezable container. It would be desirable to improve application of the dispensed fluid, e.g. by allowing the user to readily view, target, and control the dispensing of the fluent material from the package. It would be desirable to improve the appearance of the dispensing system to provide an intuitive application by the user. It would be desirable improving dispensing of the fluid, e.g. by increasing the control of dispensing for the user. It would further be desirable to improve sealing of the content, in particular during transit. Further an improved dispensing system should be able to be combined with many, if not most or all, squeezable containers. Further, it would be desirable if such an improved system could accommodate efficient, high-quality, high-speed, large volume manufacturing techniques with a reduced product reject rate to produce products having consistent operating characteristics unit-to-unit with high reliability.

WO 2013/137443 discloses a dispensing system formed by a tubular shape, in which a spout valve is received. Fluid is dispensed from the tubular shape. A soft or flexible dispensing and application tip is not disclosed. The spout valve is biased to a closed state. The spout valve is received internally of the tubular shape.

It is a goal of the invention to improve the dispensing system, such as dispensing systems known from EP 2 035 287, in at least one way. EP 2 035 287 discloses a dispensing valve comprising flexible resilient material.

In the following several embodiments and features of embodiments will be described. Any of the embodiments or described features can be combined into a single embodiment, unless specifically is indicated that combining is not possible. Any combination of the features can result in an improved dispensing system of the invention.

Embodiments of the dispensing system according to the invention can be manufactured at low costs. In particular the dispensing system allows dispensing of fluid without discretization of the dispensed amount as is normal for pumps. Most embodiments of the invention will have a spout. The spout opens at the dispensing and application end. That dispensing and application end includes a valve function, thereby reducing the volume of fluid that remains after dispensing being exposed to air/left-overs.

In accordance with aspects of the invention the dispensing and application end/spout opening is arranged such that, in use, it can be moved with respect to the housing of the dispensing system and with respect to the container on which it is mounted. In this patent application movement of the dispending end and/or spout opening relates to a global movement of the dispensing end/spout opening with respect to the housing, not including movement of (a part of) the spout opening as a result of opening or closing the spout opening.

In accordance with an aspect of the invention, the dispensing and application end/spout opening can at least make a pivoting movement. In use the dispensing end of the spout, formed by a surface on the spout having the opening, is put in contact with a surface onto which the fluid is applied. During dispensing the user can move the dispensing end over the application surface in an application direction, thereby applying a stroke of fluid onto the application surface. The dispensing end can pivot in a direction contrary to the application direction. By allowing the application end with spout opening to move in pivoting direction with respect to the housing, the spout opening can follow the contours of the surface e.g. skin or hair or wood, onto which the fluid is applied. This will improve the application of the fluid and, e.g. when applying the fluid to the body of the user, will improve the feeling. When the application end with spout opening can move, dosing of a desired amount is made easy for the user. By allowing a pivoting movement the spout opening can move during use to compensate for changing distances between container and application surface. The application end gives in. The pivoting of the application end with spout opening allows the user to apply a force during application of the fluid to a surface, while the pivoting compensates for a changing distance. The pivoting prevents disturbing the dispensing of the fluid onto the surface. The fluid can be applied by stroking the application end of the spout over the surface of application.

In accordance with an aspect of the invention, dispensing end biasing means bias the dispensing and application end, and in this embodiment bias the spout opening, to a default position, preferably extending in a distal direction away from the housing. The dispensing and application end default position biasing means are preferably formed by the spout, e.g. elasticity and resiliency of the material, in combination with the mounting of the spout in the housing. By biasing the position of the application end having the spout opening to a default position, the spout opening will return to its default position, creating a predictable behavior of the spout opening, which results in intuitive use of the spout opening by the user.

In accordance with an aspect of the invention the movement the dispensing and application end/spout opening can make, can comprise a movement in the direction of the dispensing and application end, that is a distal direction from the housing of the dispensing system. By allowing the spout opening to move in direction generally parallel to the dispensing direction (or distal direction) during use, the user can see that the pressure exerted on the fluid in the squeezable container effects the spout opening, which results in an intuitive use of the dispensing system according to the invention. The allowed distal movement in use provides the user with feedback that his squeezing of the container results in action on the spout.

In embodiments the pivoting and distal movement of the application end are combined. In embodiments the pivoting and/or the distal movement is combined with dispensing end position biasing means.

The dispensing and application end with spout opening is preferably positioned such that it extends from the spout base and/or housing. The dispensing and application end/spout opening is positioned at a distance of at least 0.5 cm from other parts of the dispensing system except for its connection via the spout to the housing.

A dispensing and application system can be mounted on the squeezable container. In an embodiment the dispensing system or the container have connection means for engaging and connecting the dispensing system to container. In an embodiment the dispensing system and container are integrally formed and the discharge opening of the container is the inlet opening of the dispensing system. Embodiments of the invention can be fixed to existing containers. The dispensing systems according to the invention can be an add-on. The dispensing systems can be manufactured in different sizes and having different connection means for connecting them to the container.

The squeezable fluid containers can have many different embodiments. They are easy to use and can be manufactured at low costs. The squeezable container can be a tube. The squeezable container allows a user to exert a force on an exterior surface of the container resulting in moving fluid from the container through a discharge opening of the container. In embodiments the bottle or container typically has resiliently flexible sidewalls which can be squeezed to pressurize the container interior.

The fluid in the container can have many different compositions. The fluid can be a cosmetic fluid or a medical fluid. The fluid can be a glue. The fluid could be edible, such as mayonnaise or ketchup. The fluid can be a solution, an emulsion or a cream. The fluid can contain hard particles.

In embodiments the dispensing system can have a spout having a spout opening. The spout focus the dispensing end and the application end. Fluid will be dispended from the spout opening to be applied by the user to a surface. The spout will have a hollow part in which fluid from the container can be present. Fluid can exit the hollow part through the spout opening.

In a first state the spout opening is open to allow dispensing of the fluid there through. The spout opening is biased to a second state in which the valve is in a more closed state. Embodiments of the invention comprise a first state in which product is easily discharged from the dispensing system and a second state in which discharging is prevented. In the second state the spout opening can withstand the weight of the product when the container is completely inverted, so that the product will not leak out unless the container is squeezed. If in the second state the spout opening is completely closed, the dispensing system in combination with the container can be referred to as an airless container. For biasing the spout opening to the second state biasing means are present in the dispensing system. The second state is not necessary airless. A small opening, big enough to allow air to enter, but small enough to block the dispensing of the fluid, can remain in the second state.

In embodiments the spout opening can have a separate valve or the spout opening itself forms a valve. The valve has the first and second state. The valve can be a flexible and/or resilient and/or self-sealing and/or slit-type valve. Preferably the valve, or in case the spout opening forms the valve, is positioned at the dispensing end. In this manner the amount of fluid remaining 'outside'/exposed to open air after dispensing is reduced to close to zero. The spout opening forms the cut-off for the fluid.

In embodiments, when the container is squeezed and the interior is subjected to sufficient increased pressure, the spout opening can transit from the second state to the first state. Instead of squeezing, discharging can be forced by 'sucking', that is providing a lower pressure on the outside. The spout opening or valve can also be designed to open inwardly to vent air into the container when the pressure within the container is less than the ambient external pressure, and this accommodates the return of the resilient container wall from an inwardly squeezed condition to the normal, unstressed condition.

In embodiments the housing of the dispensing system can have a cavity. The cavity is open at an upstream end and allows receiving the discharge opening of the squeezable container. Any of the connections between the dispensing system and container are preferably airtight, without leaks. The housing is preferably generally cylindrical. In embodiments the outside shape of the housing and the outer surface of the container will be shaped to correspond such that a smooth connection of the outer surfaces is made.

The housing of the dispensing system comprises a fluid receiving space. Preferably the volume of the fluid receiving space is small, reducing the amount of fluid present, which reduces the amount of 'left overs' and increase the direct feel of squeezing the container and application of the fluid. The fluid receiving space can be coupled to the discharge end of the squeezable container, such that fluid from the container will fill the fluid receiving space. Fluid from the fluid receiving space can reach the spout and can be dispensed through the spout opening. The fluid receiving space can be connected directly to the spout or the hollow spout stem, or can be connected indirectly via a further valve. The further valve or second valve is particularly useful in case of an airless container. The second valve is positioned preferably internally and will be harder to temper with by the user. The first valve, e.g. the spout opening, could be hampered by the user, but the second internal valve will block air entrance. In embodiments the fluid receiving space is partially or completely within the spout.

In embodiments the spout opening pivots along an arc that extends in direction perpendicular to the dispensing end direction. In embodiments the spout opening is arranged to pivot perpendicular to direction of application of the fluid from the spout opening. In such embodiments the spout base can form the imaginary hinge of the spout opening. Such pivoting can be obtained in several not expensive ways. In embodiments the spout opening can move at least 0.2 cm, more preferably at least 0.4 cm, even more preferably at least 0.6 cm, or at least 0.8 cm from its default position during pivoting. In embodiments the biasing force of the dispensing end or spout opening position biasing means is quite low. At most a 20, preferably at most a 10 N, force is needed to move the spout opening from its default position.

In an embodiment the spout is arranged to flex. The flexing of the spout allows the spout opening to move. Preferably the spout is arranged such that the spout stem with spout opening at the dispensing end can flex/pivot/tilt with respect to a spout base, the base e.g. having a flange. The connection between spout base and spout stem can have extra flexibilities to allow pivoting of the spout stem with dispensing end.

Preferably the spout extends from the housing in the dispensing end direction. In embodiments the spout opening is positioned at a distance of at least 0.5 cm, more preferably at least 0.8 cm, even more preferably at least 1 cm, from the housing.

Embodiments of the spout comprise a spout stem. The spout stem can be hollow. The spout stem can be connected to a spout base, the spout base engaged by the housing. The spout base can function as a hinge for the spout opening. In embodiments the spout base is arranged to receive fluid from the discharge end of the container. In embodiments the spout base is received in the fluid receiving space of the housing of the dispensing system. The spout stem results in a distance between a spout base and spout opening, which distance can be used to allow the spout opening to pivot. By having the spout opening at a distance from the housing, the user obtains extra control during dispensing, which as a results happens at greater distance from the container, which increases the possible manipulations the user can use during application of the fluid.

The spout is preferably formed by a flexible and/or resilient material. A silicon composition can be used. A rubbery composition can be used. In embodiments the spout, the spout stem, and/or the spout base is/are flexible. In embodiments the elasticity of the spout provides spout opening position biasing means for positioning the spout opening in a default position, when the spout is engaged by the housing of the dispensing system.

In an embodiment the spout has a dispensing tip, which has the spout opening. In further embodiments the spout has the dispensing tip with proximal thereof one or two acute side surfaces ending in the dispensing tip. The spout can have a dispensing tip shaped as a duckbill. The acute sides are shaped to provide a biasing force for the spout opening towards the second state. The duckbill is shaped to bias to the second state.

The spout opening, duckbill and/or acute side can be positioned distal from a spout stem. The spout stem can have a circular or polygonal or oval or (frusto-)conical cross-section. The cross sections can be the interior and/or exterior surface of the spout stem.

In embodiments the spout opening is a line opening, preferably formed by cutting the dispensing tip of the spout. Cutting the integral body of the spout in the dispending tip makes use of the flexible properties of the molded spout, resulting in biasing means forcing the formed spout opening to the closed position.

In embodiments the spout opening comprises a hole, the hole allowing transfer of gas, such as air, through the spout opening in the second state. In an embodiment the spout opening can have a drilled hole in the dispensing end. This further small opening can provide (additional) air inlet. This prevents complete airtight closure of the spout opening in the second state. As a result the second state allows on the one end to prevent dispensing of the fluid, but allow entrance of air into the housing and into the container. The air inflow allows the squeezable container to return to its default volume.

In further embodiments the spout is provided with an air inlet valve positioned in the spout stem or in the spout base, that is formed by a flange. In an embodiment the spout flange extends radially and an air inlet valve is provided in the radial part of the flange. In an embodiment the spout has a radially extending flange that further comprises an annular side surface. The annular side surface can be provided with the additional air inlet valve. This embodiment has the advantage of forming a spout in a single operation, including the additional air inlet valve, that can be mounted on the housing of the dispensing system. The additional air inlet valve on the annular side surface of the flange is positioned at a distance from the spout opening and spout stem. Air inflow will as a result not hinder the fluid discharge as the two functions are positioned at a distance from each other.

In embodiments the spout comprises a flange, preferably at the spout base end. The flange can extend in a direction perpendicular to the dispensing direction. The flange is positioned at a spout base at a distance from the spout opening. The flange and the material properties of the spout body provide for the flexibility to allow the spout opening and dispensing end to pivot with respect to the spout base/housing. Further the flange can form a surface of a diaphram for allowing the spout opening to move in the dispensing direction. Such a flange will provide the user with visible feedback and will improve the intuitive use of the spout and dispensing system.

The flange can be flexible. In other embodiments the flange is arranged in a guide to allow movement of the flange with respect to the housing.

The flange can be formed as an integral part of the flexible spout body. This allows forming a spout having several functions in a single or possibly two or three step, operation, e.g. by injection molding.

In an embodiment the flange is engaged by the housing. The housing and the flange can have a fixation system. A circumferential edge of the flange can be engaged by the housing of the dispensing system. An annular part of the flange can be engaged. The flange can have one or more annular grooves. The housing can comprise two parts that fix the flange in between. In an embodiment a chemical or mechanical bond is formed between flange and housing.

In an embodiment the flange is arranged as a diaphram arranged to allow the spout opening to move in a direction of the dispensing end. The diaphram operation allows the flange to take on a cone like shape. This will also create extra spacing on the inside of the spout and/or dispensing system. The extra space can be filled with fluid. When e.g. the fluid container with dispensing system is stored or transported, high forces can be exerted on the container. By allowing the extra space to fill with fluid, part of the pressure on the spout opening is taken away. An circumferential edge of the flange can be engaged by the housing of the dispensing system. This allows making use of the flexible properties of the flange and creating the diaphram operation. By engaging a circumferential edge of the flange, use can be made of the flexible properties of the flange and creating the diaphram operation.

The axial movement of the spout opening, in particular as a result of the diaphram operation of the flange, also allows the spout opening to move towards an overcap, if the overcap is positioned over the spout. The overcap can have a blocking device to engage the spout/spout opening. The blocking device can be arranged to (help) close the spout opening. If a force is exerted on the squeezable container and the overcap is positioned over the spout, the axial movement/diaphram operation will result in the spout opening being pushed hard onto the blocking device of the overcap, further aiding closure of the spout opening, preventing unwanted release of fluid.

In embodiments the spout end and a blocking device engaging the spout are dimensioned to allow engagement of the blocking device such that the spout and specifically the spout opening is closed by squeezing of wall parts of the blocking device on wall parts of the spout end, specifically the duckbill surfaces. In embodiments the spout is marginally overdimensioned with respect to the blocking device. E.g. the spout is 0.5 mm large than the block device engaging the spout. By inserting the spout end into the recess wall parts will engage and squeeze on the spout. Specifically wall parts having a V-shape in cross-section are suitable.

In embodiments the overcap has a recess for receiving a tip of the spout. The recess is shaped as a slit, receiving the distal end part of the spout. In preferred embodiment the recess angled in cross section. The angle generally corresponds with the angle of the duckbill shaped spout. The recess can be V-shaped in cross-section. The V-shape can receive the similarly generally V-shaped tip of the spout having the valve/fluid exit. In embodiments deeper parts of the recess are sharper V-shaped than less deep parts. The end part of the recess that engages the tip of the spout that has the spout opening, is thereby more tightly squeezed, thereby biasing the spout opening to a closed state, preventing leakage when the spout is received in the overcap recess, in which position leakage should be prevented. In embodiments the recess has, in cross sections, walls that are positioned at an angle that is sharper than the angles of the walls of the spout, thereby being arranged to squeeze the walls of the spout.

Further the overcap, in preferred embodiments the recess in the overcap, can have a notch, for example a rounded notch, that is arranged to be received in the spout opening on the spout tip to close the opening. A rounded notch is preferred in case of a flip-top overcap closure. The rounded notch will pivot into the circular spout opening, blocking exiting of fluid.

The flange can form part of spout opening position biasing means to bias the spout opening to a default position. Preferably the default position is the flange being perpendicular to the dispensing direction.

In an embodiment the flange forms an outer surface of the dispensing system, preferably covering a part of the housing, preferably covering the fluid receiving space.

Preferably the spout comprises an integral flexible body having: the spout opening; and/or the biasing means; and/or a hollow spout stem. Further the integral flexible body can comprise a spout base. Preferably the spout base comprises a flange. The spout base can engage the housing, which allows positioning the spout onto the housing.

The application and dispensing tip is the most distal end of the spout and is preferably shaped as a surface, preferably a flat surface or application strip shaped and arranged to contact a surface over a part of the surface area of that application strip. The spout opening can be formed in the surface area of the application strip. The application strip forms a distal surface of the spout intended to contact the surface onto which the fluid is to be dispensed. The application strip can be 1-4 millimeters wide and more than 5 millimeters in length. Such surface forms a robust end of the spout. The application strip allows forming a spout dispensing end of sufficient thickness, e.g. which helps during formation of the spout during injection moulding. Sufficient elastic material can be used to form the application strip. Such a thicker strip having the spout opening also allows closing of the spout opening (second state) preventing the outflow of thicker fluids such as fluids with a high viscosity.

The spout opening is formed in the application strip. The spout opening preferably extends in the strip's direction. Preferably the application strip extends in a direction perpendicular to the application direction. This is an intuitive design for the user.

The spout opening can have many different shapes. It can be formed by cutting the spout, preferably cutting the dispending and application tip or strip. The spout opening can be a line, preferably extending over at least 25% of the dispensing and application end strip. In embodiment the spout opening is shaped as a cross or as a Y. In embodiments a zigzag spout opening is formed. This allows adapting the spout opening to properties of the fluid contained in the squeezable container, e.g. a fluid containing rigid particles.

In embodiments the size, in particular the cross-section, of the hollow spout (internal volume of the spout upstream from the spout opening) is made to correspond with the size, in particular the cross-section, of the discharge end of the squeezable container. Especially if the spout channel is arranged as a cylindrical extension of the discharge end of the squeezable container, fluid can flow from the container through the spout without much friction, increasing the direct control for the user. In embodiments an adaptation ring or disc can be used to overcome size differences between spout and discharge end.

In an embodiment the dispensing system comprises an overcap. The overcap can cover part of the dispensing system, preferably cover the spout. The overcap can be a separate part or can be part of the dispensing system, e.g. connected to the housing. The connection can comprise a hinge, e.g. a bending hinge. To allow dispensing, the overcap is removed and the spout is uncovered.

Preferably the overcap is transparent. This allows the user to view and recognize the spout.

To aid the blocking of fluid leaving the dispensing system, the overcap can comprises (and/or the spout can have) a blocking device. The blocking device aids in bringing the spout opening to the second closed state. To that end the overcap is shaped and formed to engage the spout. The engagement can be such that the spout opening is closed off. When the overcap is on the dispensing system, fluid dispensing is undesired. The overcap support preventing fluid dispensing by blocking the spout opening.

In embodiments the squeezable container comprises an inner container, such as a pouch, for the fluid. The pouch is adapted to be shaped in accordance with the quantity of fluid left in the container. This allows having an outer surface of the container that keeps its (close to) original shape, while the inner container is adapted to the left over volume. This is particularly preferred in case of an airless container.

In embodiments the container comprises a inlet valve. The inlet valve allows the entry of air to take the volume of the dispensed fluid.

According to aspects of the invention the dispensing system is provided with or without a container. In embodiments the dispensing system is an integral part of the container. In embodiments the dispensing system is sealed to the container.

According to a further aspect a method for manufacturing a dispensing system for, in some embodiments in combination with, a squeezable container is provided.

Methods for forming the dispensing system comprise a forming operation, such as injection molding, of the dispensing system.

Part of the method is forming an integral flexible spout body having the spout opening that can be opened in a first state to allow dispensing of the fluid there through and biasing means for biasing the spout opening in a second, more closed, state.

Preferably the flange is formed in a single operation on the integral flexible spout body.

In embodiments the spout is formed having a dispensing end, preferably a dispensing and application strip. Subsequently the spout opening is formed in the dispensing end. In some embodiment the spout opening is formed by cutting the dispensing end. Cutting is an example of a non-material removing technique for creating the spout opening.

Further the method comprises providing a hole in the spout, preferably in the dispensing end, preferably at the spout opening. The hole is preferably formed by a material-removing technique such as drilling. In other embodiments the hole is formed during injection molding. The hole allows entry of air through the spout opening into the squeezable container. Preferably the hole is arranged as air inlet in the second state of the spout opening. The hole can be circular or oval in cross-section. An oval hole is preferred in that it can be more easily squeezed and thereby closed by a engagement by a blocking device. An oval opening is more flexible/less rigid than a circular opening.

Any of the features described, any of the advantages described herein can be combined in a single embodiment, unless explicitly indicated that such can not be done. The dispensing system or closure system of this invention is suitable for use with a variety of conventional or special containers having various designs, the details of which, although not illustrated or described, would be apparent to those having skill in the art and an understanding of such containers. It will also be understood by those of ordinary skill that novel and non-obvious inventive aspects are embodied in the described exemplary dispensing system, but also in the not-explicitly described possible combinations of features disclosed herein.

The invention will be described in more detail with reference to preferred embodiments shown in the figures. However the invention is in no way limited to the disclosed or shown embodiments. Identical or similar features are indicated with the same reference numeral.

SHORT DESCRIPTION OF THE FIGURES

In the drawings:

FIGS. 1*a*& 1*b* show cross sectional views of a first embodiment of a dispensing system 1 and container 9 according to the invention;

FIGS. 2*a*-2*l* show perspective views of embodiments of a dispending end of a spout according to the invention;

FIGS. 3*a*-3*c* show views of embodiments of the application and dispensing system having an overcap, mounted on a squeezable container;

FIGS. 4*a*-4*f* show views of further embodiments of the spout and overcap;

FIG. 5 shows a view of an embodiment of spout and overcap;

FIG. 6A-C show further embodiments of a spout according to the invention;

Figure 13A:
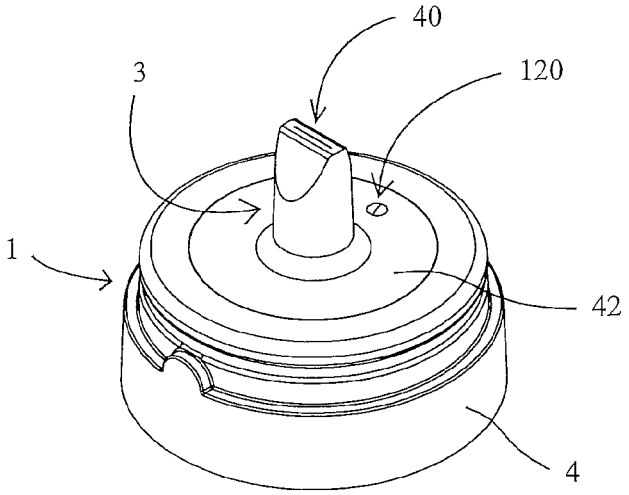
Figure 13B:
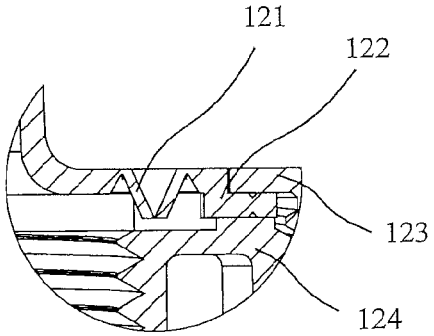
Figure 14A:
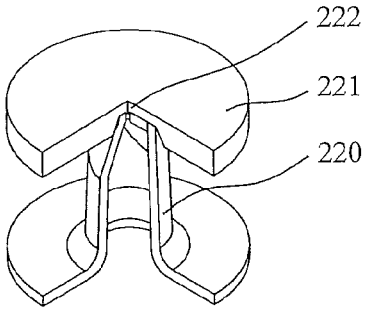
Figure 14B:
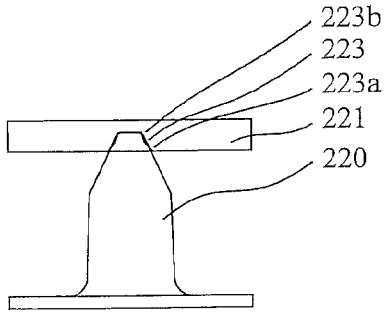
Figure 14C:
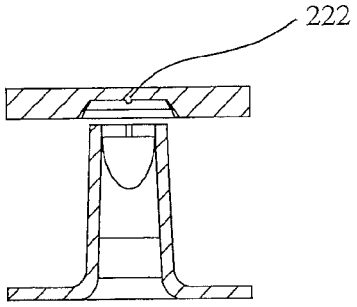

FIGS. 13*a*-13*b* show an embodiment having an additional air inlet valve;

FIGS. 14*a*-14*c* show an embodiment of spout and overcap.

DESCRIPTION OF THE PREFERRED EMBODIMENTS

While this invention can be used in embodiments in many different forms, this specification and the accompanying drawings disclose only some specific forms as examples of the invention. The invention is not intended to be limited to the embodiments so described, however. The scope of the invention is pointed out in the appended claims. For ease of description, many of the figures illustrating the invention show a dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

Figure 1A:
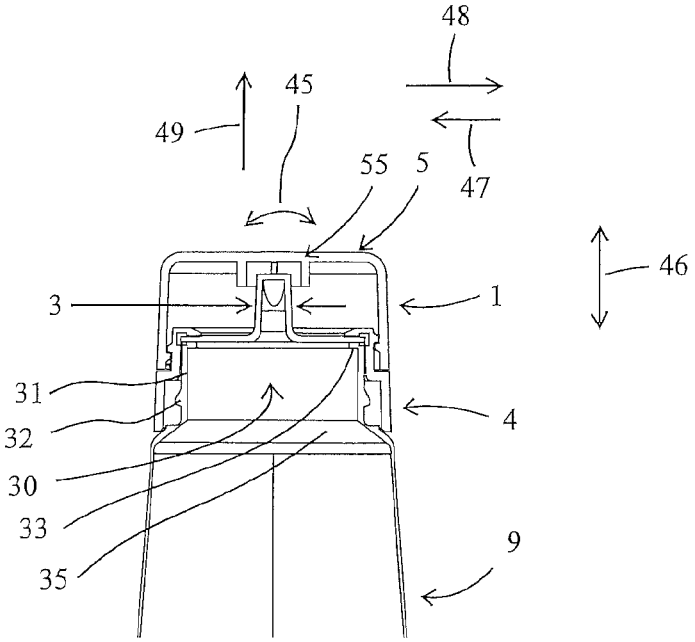
Figure 1B:
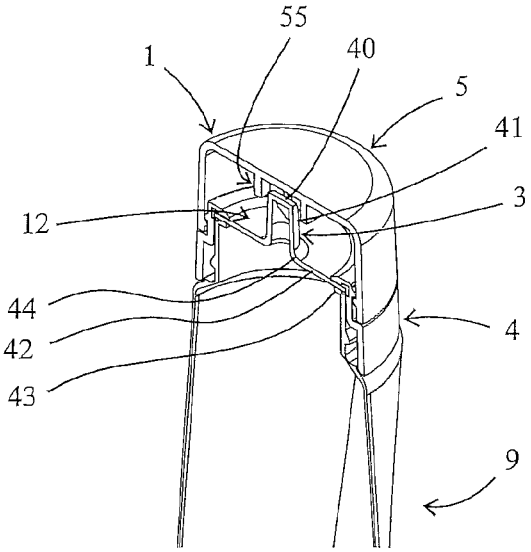

A first embodiment in accordance with the invention is shown in FIG. 1. A dispensing system 1 is mounted on a squeezable fluid container 9.

The fluid container walls can be squeezed resulting in the fluid being forced out of the discharge end 30 of the container 9. The illustrated discharge end 30 comprises an opening 33 near the end of a neck part 31. The neck part 31 has an annular ring 32. The neck part 31 is a cylindrical extension on a collar part 35. The collar 35 and/or neck part 31 can be separate parts connected, e.g. sealed, to the fluid container 9.

The fluid container 9 can be a squeezable tube having flexible walls. The fluid container 9 can have walls which can be grasped by the user and squeezed or compressed to increase the internal pressure within the container so as to force the product out of the container and through the dispensing system. Such a flexible container wall typically has sufficient, inherent resiliency so that when the squeezing forces are removed, the container wall returns to its normal, unstressed shape. Such a squeezable-container is preferred in many applications, but may not be necessary or preferred in other applications. For example, in some applications it may be desirable to employ a generally rigid container, and to pressurize the container interior at selected times with a piston or other pressurizing system, or to reduce the exterior ambient pressure so as to suck the material out through the open closure.

Although the container 9 does not form a part of the broadest aspects of the present invention, it will be appreciated that at least the housing 4 (or a further intermediate component) of the application and dispensing system 1 of the present invention optionally may be provided as a unitary portion, or extension, of the top of the container 9. However, in the preferred embodiment as illustrated, the dispensing system 1 is a separate article or unit, which can be either one-piece or multiple pieces, and which is adapted to be removably, or non-removably, installed on a previously manufactured container 9 that has a discharge end 30 for discharging fluid from the container interior. Also in embodiments the container and dispensing system are integrally formed. In particular a shoulderless squeezable container is used to integrally form a container with application and dispensing system.

In embodiments the container 9 comprises an inner container or pouch. Still the user will be able to squeeze the container to exert force of the fluid to be dispensed, but the squeezable container will after use return to its default position, while the pouch will take on a small volume, equal to the remaining amount of fluid in the container.

The application and dispensing system 1 can be used to dispense many materials, including, but not limited to, relatively low or high viscosity liquids, creams, gels, suspensions, mixtures, lotions, etc. (such as a material constituting a food product, a beverage product, a personal care product, an industrial or household cleaning product, or other compositions of matter (e.g., compositions for use in activities involving manufacturing, commercial or household maintenance, construction, agriculture, medical treatment, military operations, etc.)).

The application and dispensing system 1 is mounted on the discharge end 30 of the container 9. In an embodiment a connection system is provided to connect the housing to the system 1. The connection system can comprise the annular ring 32 of the neck part 31. In other embodiments the neck part 31 is provided with threaded profiles and an internal surface of the housing 4 is also provided with a threaded profile to engage one and other. In the shown embodiment the housing 4 clamps onto the neck part 31 and/or on collar 35. In yet other embodiments the dispensing system and/or the discharge end of the squeezable container have a bayonet fitting or another click system to make an airtight connection between the two. Glue can be used to make a connection.

In the illustrated embodiment, the housing 4 is shaped as a cylindrical body having a cavity in which the neck part 31 can be received. In an embodiment the cavity of housing 4 can receive fluid from the discharge end 30. The cavity is a fluid receiving space. In the shown embodiment, although the neck part 31 is the first received part, also fluid will be in the cavity albeit inside the neck part 31 of the discharge end 30. In other embodiments the fluid receiving space of the housing 4 can comprises a channel or a fluid connection space.

Although a direct connection of the housing 4 to the discharge end 30 is preferred, indirect connections, e.g. using a transition piece or sealing ring are also possible. The sealing ring, transition piece can be part of the connection system between container 9 and housing 4.

Fluid is transferred to and received in the hollow spout 3, which forms a further fluid receiving space of the dispensing system 1. Housing 4 is part of the application and dispensing system 1. The dispensing system 1 also comprises the spout 3. Spout 3 also forms the application and dispensing end 40 from which the fluid is released and applied to a surface by the user.

Spout 3 can have a spout opening from which fluid is dispensed. The spout opening also forms the dispensing and application end of the spout. The spout opening can be opened, a first state, to allow fluid to exit the spout opening. By default, as a result of biasing means, the spout opening is in a second state in which the outflow of fluid is prevented. The second state can be a completely closed state, resulting in an airless container system or can be a state in which fluid outflow is prevented, but air inflow is still possible. The air inflow in the second state is beneficial to allow the squeezable container to return to its default condition or can be beneficial for air to settle in the container with the fluid, especially air flowing to the proximal (or bottom) end of the container.

The spout opening can have a separate valve having the first and second state. The separate valve could be positioned at a distance from the dispensing end 40. However it is preferred that the spout opening and its valve function are embodied in the integral body of the spout 3. Preferably a duckbill embodiment is used.

The spout 3 can be a flexible body. Preferably the spout 3 has an integral flexible body comprising spout opening and biasing means for biasing the spout opening to a second, generally closed, state.

Spout 3, as can be seen from the cross-sectional views of FIG. 1, comprises a dispensing end 40 having a dispensing and application strip as the most distal part. The dispensing and application strip has the spout opening (not visible/shown in FIG. 1). FIG. 1 shows the dispensing end in the second state: outflow of fluid is mostly prevented. In use, that is due to applying a squeezing force on the container, fluid can flow through the spout opening from the spout 3. The spout opening can take on a, different, first state, in which the opposite sides of a cut line in the dispensing end move away from each other, thereby creating an outflow opening for the fluid.

The user can direct the dispensing end at the surface on to which he wants to apply the fluid from the squeezable container 9. The dispensing and application strip provides an intuitive design that allows any user to quickly understand that fluid will become available from that application strip if pressure is applied.

Proximal from the dispensing and application strip a hollow spout stem 41 is formed, which at its proximal end has a base formed by a flange 42. The hollow spout stem can receive fluid and will allow fluid to flow towards the dispensing end 40 when being dispensed. The hollow spout stem represents a small volume in which a volume of fluid is held ready to be dispensed. In the embodiment the hollow stem is cylindrical: little flow resistance will occur when the fluid is being dispensed. Also no cavities are present into which fluid can enter and in which fluid can be held. In this manner deterioration of the fluid due to e.g. drying out in the spout stem 41 is prevented.

FIG. 1 shows the spout stem 41 extending in a direction parallel to the dispensing direction. The spout opening on dispensing end 40 is held at a predetermined distance from the rest of the housing 4 of the dispensing system 1. This is advantageous for applying the fluid as the extra predetermined distance allows the user to reach the application surface more easily. A tip like spout 3 allows the user to apply the fluid directly onto the desired surface.

Spout stem 41, part of the integral flexible body of the spout 9, is also flexible. Although its tubular shape will provide the spout stem with some rigidity in the axial direction, the spout stem 41 via its connection 44 with flange 42 will be able to pivot. Connection 44 *c* can have a smaller thickness, allowing the connection 44 to act as a hinging point. As a result the spout stem 41, the spout opening and the dispensing end 40 can move according arrow 45. When applying the fluid onto a surface in an application direction 48 with the dispensing end 40 contacting that surface, the spout stem/spout opening can pivot in a direction 47 against the direction of application 48. The fluid will be dispensed in a similar action as the hairs of a paint brush. The pivoting will compensate changes in the distance between the container/dispensing system and the surface onto which the fluid is applied. If the surface onto which the fluid is applied is the user's skin, the user will experience a gentle touch of the spout only, as the flexible spout gives in.

In preferred embodiments the spout 3 is formed from a deformable material. The spout 3 has a base 44 that allows hinging the spout stem 41 and dispensing end 40 with respect to the housing 4.

Clearly also other embodiments, e.g. not having an integral flexible spout body are possible to allow the spout opening to pivot. In embodiments a hinge is used. In embodiments the spout stem can bend. In embodiments multiple components are used to form the dispensing end 40, spout stem 41 and/or spout flange 42. In embodiments the spout 3 comprises the spout stem 41 and dispensing end 40 having the spout opening. A hinge replaces connection 44.

FIG. 1 shows the spout 3 in a default state: dispensing end/spout opening position biasing means will position the dispensing end 40/the spout opening in the shown position. Flexibility of the spout 3 allows the dispensing end 40 to move in direction 45, in a direction sideward of the dispensing direction, which is axially outward in the shown embodiment. The dispensing direction is shown by arrow 46.

The dispensing end or spout opening position biasing means bias the spout opening to the illustrated position, in which the spout extends generally in direction parallel to the dispensing direction. From this default position the spout opening or dispensing end can tilt. From this default position the spout opening or dispensing end can move axially.

In the shown embodiment the integral flexible spout body is arranged to function as a dispensing end position biasing means for the spout opening. Further the integral flexible spout body also provides the biasing means biasing the spout opening to the second state. The spout according to the invention can be molded in a single operation and with limited extra operations, e.g. cutting the spout opening in the spout and/or drilling the additional hole as air inlet, the spout body will provide for several advantageous functions.

In other embodiments the spout stem 41 can have a default direction somewhat acute to the dispensing direction. Although the spout stem 41 is shown as a central part of the spout 3, it can be positioned off-center.

The length of the stem (starting at the base up until the dispensing end) is at least 0.5 or at least 0.8 cm, preferably at least 1.2 cm, more preferably at least 1.5 cm. The stem length will position the dispensing strip 15 at a distance from the rigid housing 4.

Despite the fact that housing 4 in FIG. 1 is shaped to cover the relatively large discharge end 30 of the container 9, thereby forming a relatively large shoulder, the extending spout with dispensing end allows the user to apply the fluid to the desired surface, despite the presence of this relative large shoulder.

The outer spout diameter can be between 4 and 25 mm, preferably 5 and 20 mm, more preferably between 6 and 11 mm.

The circumferential edge 43 of the flange 42 is engaged by the housing 4. Housing 4 can have a receiving slit for the flange edge 43. The flange 42 can, in the shown embodiment, act as a diaphram mounted on the housing 4. Its inner part, with spout stem 41 and spout dispensing end 40 can move upward and downward according to arrow 46, while the circumferential edge 43 is being held in position with respect to the housing 4. As a result the spout opening can move in an axial or distal direction, parallel to the direction of dispensing.

In embodiments a disc, having at least an opening in a central part, can be positioned under the flange, preventing further movement against the dispensing direction 49. The disc can be held by the housing. The disc can be part of the housing. In its default position, biased by dispensing end position biasing means, the flange 42 will engage on the surface of the disc. In such an embodiment the spout can move from the position as shown in FIG. 1 in the dispensing direction and back to the shown default position.

As a result of a squeezing force on the squeezable container, fluid is pushed through the neck part 31 reaching the hollow spout stem 41. The fluid will push onto the flange part 42, moving it outward in the dispensing direction 49. The flange 42 will from a generally perpendicular to the dispensing direction 49 default position move to a frusto-conical position, in which the spout stem 41 and spout dispensing end 40 with spout opening move in the dispensing direction 49 with respect to the housing.

Such a frusto-conical shape will be noticeable for the user as the spout 3 and spout flange 42 form exterior parts of the dispensing system 1. When the user applies force, the moving of the flange to the frusto-conical shape provides the user with instant feedback that he is doing the right thing.

Further the frusto-conical shape of the flange will increase the internal volume of the dispensing system, allowing more fluid to be present in the application and dispensing system. In case the squeezable container 9 with dispensing system 1 is being transported, not yet used, unwanted forces can be applied to the container wall 9, which could result in spilling. The frusto-conical shape of the flange 42 allows to increase the volume without unwanted dispensing of the fluid.

It is presently contemplated that many applications employing the dispensing system 1 will conveniently be realized by molding at least some of the components of the dispensing system 1 from suitable thermoplastic material or materials. In the preferred embodiment illustrated, some of the components of the closure could be molded from a suitable thermoplastic material, such as, but not limited to, polypropylene. The closure components may be separately molded—and may be molded from different materials. The materials may have the same or different colors and textures.

In the preferred form of the invention, an optional overcap 5 is provided as a cover of the dispensing system 1. If the overcap 5 is mounted on the dispensing system part of the dispensing system is covered and in particular spout 3 is covered. The overcap 5 can be removed to expose the spout 3 for dispensing. The overcap 5 is movable between (1) a closed position over the spout 3 and onto the housing 4 and (2) an open or removed position. The overcap 5 may be a separate component which is completely removable from the housing 4, or the overcap 5 may be tethered to the housing 4 with a strap, or the overcap 5 may be hinged to the housing 4 so as to accommodate pivoting movement from the closed position to an open position.

As can be seen in FIG. 1, housing 4 includes a peripheral collar 51 on an exterior surface thereof. The overcap 5 has cam 52 on an interior surface. The collar 51 and cam 52 can engage.

Preferably an overcap engagement system is used that allows positioning the overcap 5 in a defined relation onto the housing 4. This allows providing the spout 3 and/or the overcap 5 with spout engaging means, preferably spout opening blocking device 55.

In the shown embodiment overcap 5 is provided with spout opening blocking device 55. The blocking device 55 engage the spout 3 near the dispensing end 40. Blocking device 55 can comprise one or more cams. The blocking device 55 are arranged to bias the spout opening in the second state or even a more closed or fully closed state of the spout opening preventing the outflow of fluid therefrom.

In combination with the spout being arranged to allow the spout opening to move in the dispensing direction 49, a further advantage is obtained. If a force is exerted on the squeezable container 9 when the overcap 5 is mounted on the housing 4, the spout opening on the dispensing end 40 will move in the axial direction 49, being pushed even hard onto the cams of the blocking device 55. As a result the cams will close of the spout opening even more, preventing the unwanted outflow of fluid from the dispensing opening.

Figure 3A:
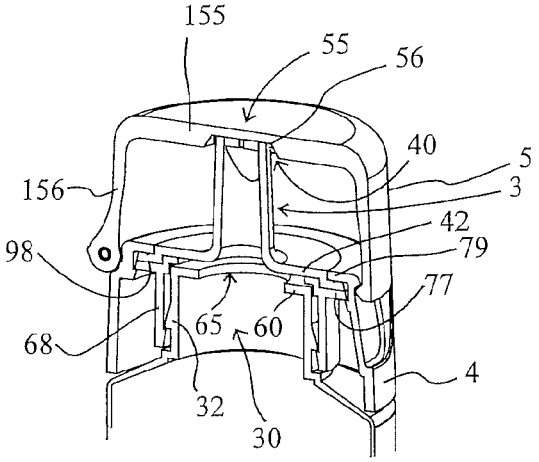

FIG. 3*a* shows another embodiment of blocking device 55 in more detail. The dispensing and application end 40 having the opening 38 of spout 3 is received in an recess 56 at the inner side of the overcap 5. Recess 56 is sized to receive the dispensing and application end. The recess will provide an bias towards the second state in which leakage of the fluid from the spout opening is prevented and will prevent the dispensing end from moving more distal. In this embodiment the overcap will have a thicker top surface 155 in which recess 56 is formed than radial side 156. The thicker top surface allows forming the recess.

In certain embodiments, e.g. in combination with embodiment 2B, the recess 56 is configured such that even the opening 38 is closed, resulting in an airtight closure even of spouts that are embodied as non-airless spouts.

Further FIG. 3*a* shows a discharge end 30 having a flange 60 with an opening 65. The flange 60 is positioned underneath the spout 3 and underneath spout flange 42. The dimensions of opening 65 and the cross-section of the stem of spout 3 correspond.

An intermediate housing part 68 engages annular ring 32 of discharge end 30. The intermediate housing part also has a engaging surface 77. The flange 42 having an extra circumferential edge 78 is positioned on one side of the engaging surface. Another side is engaged by a housing 4, which housing 4 also has ring 79 that engages the flange 42. Thereby a fixation system is formed locking the flange 42 and thereby the spout 3 in position in between housing 4 and intermediate housing 68. The extra circumferential edge 78 is locked.

Figure 3C:
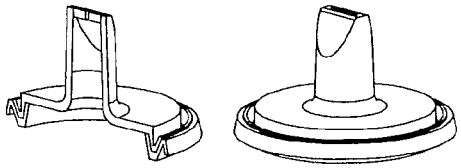
Figure 3C:
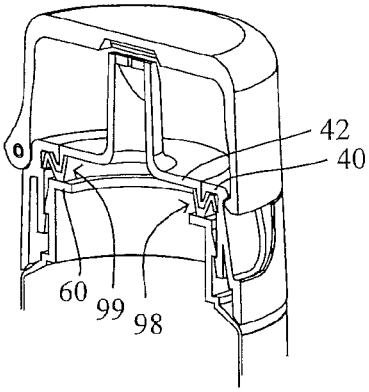
Figure 3B:
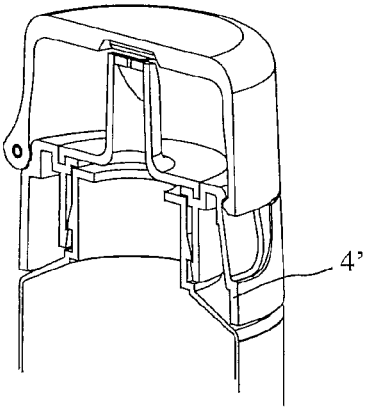

FIG. 3*b* shows an alternative connection system for connecting and fixing the spout 3 to housing 4. Here a single housing 4' engages both the spout 3 and the discharge end 30 of the container 9. The spout can be locked by bonding. In embodiments FIG. 3*b* is formed by 2*k* molding.

FIG. 3*c* shows an another alternative. The spout 3 is formed with an edge 98 on the flange 42 formed by 2*k* molding and comprising the flexible material of the spout 3 and a harder second plastic 99 as reinforcement. The edge 98 is clamped between a flange 60 of the discharge end 30 and the housing 4.

Figure 2:
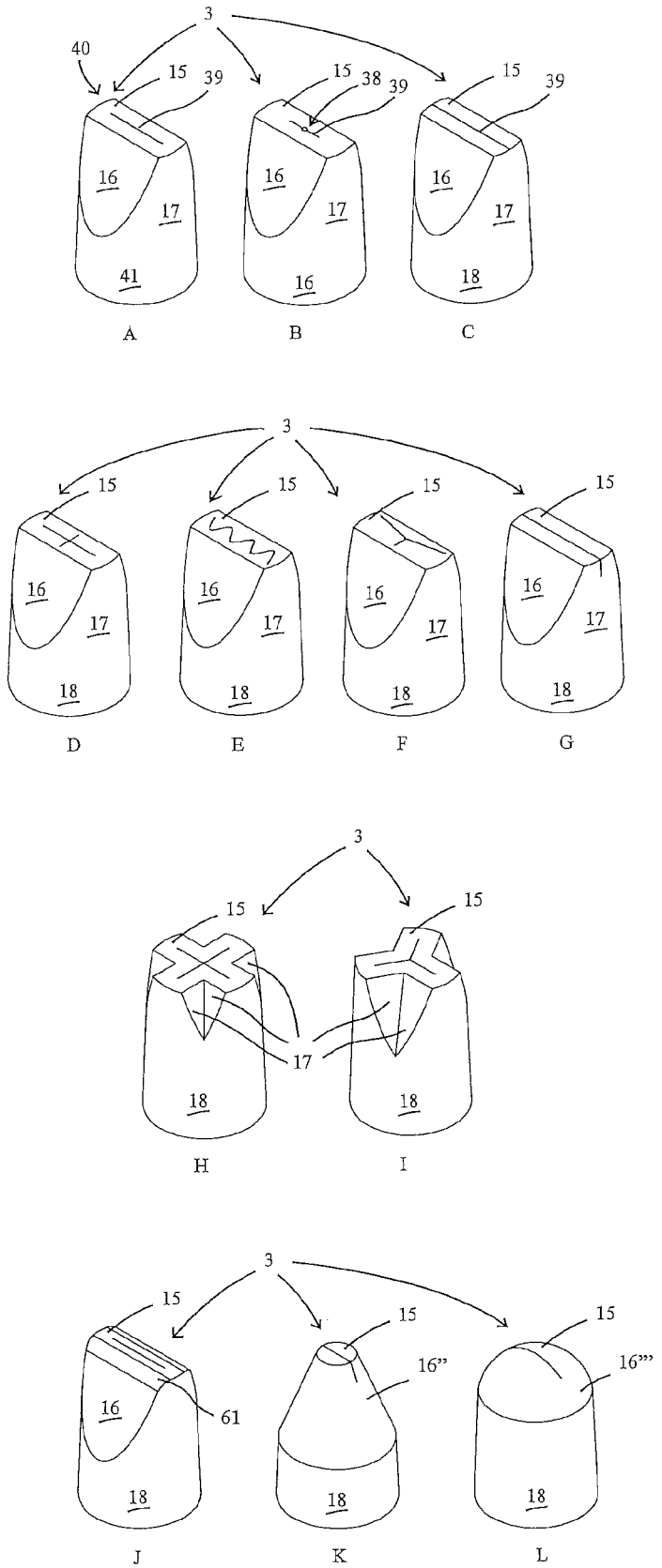

Now reference will be made to FIG. 2 showing exemplary embodiments A-L of a dispensing end 40 of spout 3.

The dispensing and application strip 15 has the spout opening 39. Embodiments A-G of FIG. 2 show a spout 3 with a stem 41 that provides near the distal end thereof acute surfaces 16. The acute surfaces 16 as well as parts of the cylindrical spout stem walls 17 converge into the dispensing end 40 forming by dispensing and application strip 15. The acute surfaces 16 and stem walls cooperate to operate as biasing means for the spout opening 39.

The acute surfaces 16 and stem walls 17 are shaped similar to a duckbill valve. Accordingly a spout 3 is formed from an integral flexible body in which the spout opening 39 is formed and which body provides biasing means for biasing the spout opening to a closed position.

The spout opening 39 will have at least two states. FIGS. 1 and 2 show a state in which fluid is prevented from being dispensed from the spout opening 39. This is the second state. The biasing means bias the spout opening 39 toward this second state. In the second state the spout opening does not need to be completely (air tight) closed. If it is airtight closed, an airless closure is obtained. The spout opening 39 can also take on a first state in which the respective side surface adjacent the spout opening move away from each other, resulting in an opening through which fluid can flow. The first state (in which the spout opening can have one or more opened positions, e.g. different distances between the side surfaces of the spout opening) allows the dispensing of fluid. The spout opening can transfer from its default second state to the first state by applying a force on the squeezable container. The amount of opening of the spout opening can be dependent on the applied force. The exerted force is sufficient counter the biasing force biasing the spout opening to the second state. The biasing force can be low, e.g. less than 10N, preferably less than 5N.

Embodiments A-C of FIG. 2 show straight spout openings 39 of different lengths. The spout openings 39 are formed by cutting a line in the surface of the dispensing and application strip 15.

Spout 3 can be formed from a plastic, e.g. by injection molding. The spout opening 39 can be provided by cutting the dispensing and application strip 15. Cutting is performed without removing spout material. Although the dispensing and application strip 15 is cut and the adjacent surfaces are no longer connected, the shape (duckbill) of the spout 3 is such that a biasing force is provided, biasing the spout opening to a position in which the adjacent surfaces of the cut spout opening are moved toward each other, preventing leakage of fluid.

Embodiments A-L can be spouts that provide an airless closure. Embodiment B shows an extra opening in the dispensing and application strip 15. Not only a spout opening 39 is cut in the dispensing and application strip 15, but also an air vent opening 38 is formed, preferably by a method of removing spout material, in the dispensing and application strip.

FIG. 2B shows the hole 38 out of proportion/not to scale. The hole 38 is small enough to prevent the outflow of (viscous) fluid, but allows the inflow of air into the dispensing system and into the squeezable container. In embodiments multiple holes are formed. In embodiment the hole is made on the spout, not on the dispensing end.

In embodiments the hole is made on the spout stem. In embodiments the hole is circular. In embodiments the hole 38 is oval. In embodiments the hole 38 is at least 0.15 mm, more preferably at least 0.2 mm, in cross-section. In embodiments the hole 38 is at most 0.9 mm, preferably at most 0.8 mm in cross-section. Combinations of these ranges are possible.

In embodiment small cams are provided on the spout, near the spout dispensing end, e.g. on the acute surfaces on both sides of the opening 38. These cams, sized similar to the hole 38, can be engaged by a blocking device 55 of the overcap 5. These cams, if engaged, result in an increase force on the spout, closing of the hole 38 for air, resulting in an airless closure.

In the second state the hole 38 provides an air vent for air to enter the dispensing system. In the second state the spout opening needs not to be completely closed.

Spout stem 41 has a circular base 18. Several other forms as possible too. The cylindrical shape or other shape supports rigidity of the stem 41 to stand upright from the housing 4 as shown in FIG. 1. This will bias the dispensing and application strip 15 having the spout opening in a default position with respect to the housing in which the dispensing and application strip 15 is at predetermined distance from the housing. The stem 41 will have more flexibility than the acute surfaces 16, which will allow a pivoting movement of the dispensing end 40 and spout opening 39 with respect to the housing 4. The pivoting of the spout opening also allows easy cleaning of the spout 3. Remaining fluid can be wiped off.

Embodiment 2D shows a spout opening formed as a cross. Embodiment 2E shows a undulating spout opening. Embodiment F shows a star shaped spout opening. In embodiment G the spout opening is provided not only on the dispensing and application strip 15, but also in the stem walls 17.

Embodiments H-L show further alternatives. Here still the duckbill valve functionality is maintained as well as forming the spout 3 as an integral flexible body having both the spout opening 39 as well as biasing means biasing the spout opening 39 toward the second state. In embodiment H the dispensing end 40 is shaped as a cross, whereas in embodiment I the dispensing end 40 is shaped as a star. A spout opening is cut across a major part of the dispending end 40 in these embodiments. Embodiment J shows a dispending end 40 having several strips, including dispensing and application strip 61. In embodiment K a frustoconical dispensing and application tip 16" is formed having the dispending end 40. The dispensing and application tip 16" still biases the spout opening 39 toward the second state. In embodiment L a spherical dispensing tip 16'" is formed having the spout opening 39. Clearly different spout openings 39 can be combined with different dispensing tips 16"/16'" or dispensing ends 40.

Figure 4:
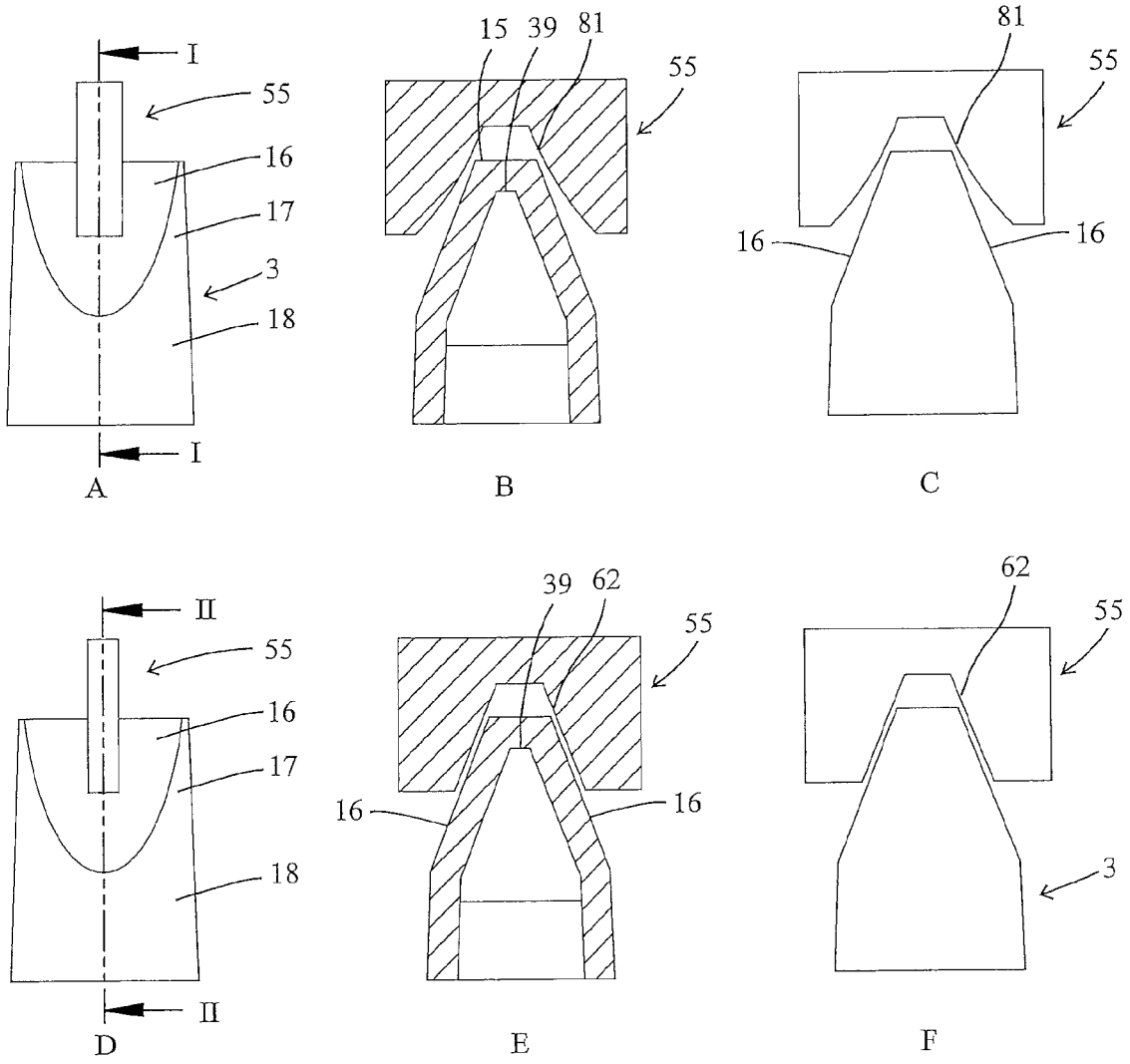

FIGS. 4*a*-4*f* show two further embodiments of the blocking device 55. FIGS. 4A and 4C show views of a spout 3 having acute surfaces 16. Overcap 5 is not shown in the Figures, but blocking device 55 is, which similarly to FIG. 1 extends from an interior surface of the overcap to engage the spout. FIG. 4B is the cross sectional view along A-A in FIG. 4*a*. Blocking device 55 in FIGS. 4*a*-4*c* has cams 81, which engage the acute surfaces 16. Cams 81 are curved. If the spout 3 is moved in the axial direction, the spout is squeezed increasingly by the cams, resulting in a higher closing force. Cams 81 are arranged to maintain at least the second state of the spout opening and preferably can close the spout opening 39 even more, e.g. to an airtight closure.

FIGS. 4D-4F show another embodiment. FIG. 4E is the cross section along II-II in FIG. 4D. Blocking device 55 now has straight walls 62 positioned at a constant angle with respect to the overcap. The angle is generally the same as the angle of the acute surfaces. In this embodiment a major part of the acute surfaces 16 will be engaged by the walls 62, whereas in FIGS. 4A-4C the contact will be closer to a point contact.

Figure 5:
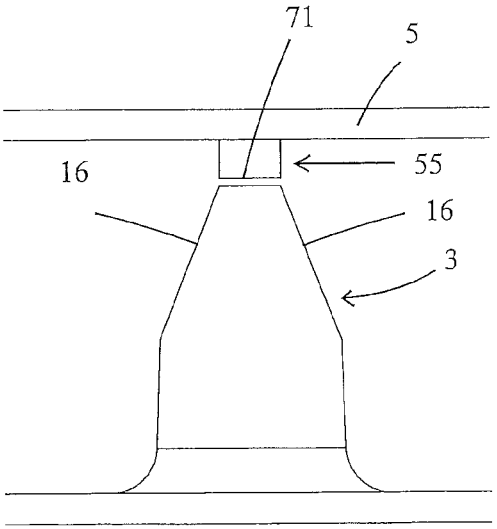

FIG. 5 shows another embodiment of the blocking device 55, here embodied by a nut 71, which forms a pressure surface to engage the dispensing strip 15. Here the blocking device 55 is arranged to provide additional closing of the spout opening, albeit that also this blocking device biases the spout opening to the second state.

The width of the cams 56, nut 71 or surfaces 81/62 can vary. Multiple adjacent cams/nuts/surfaces can be used to provide better engagement.

Figure 6A:
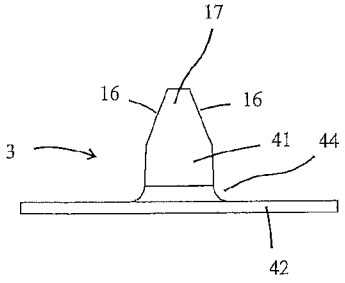

FIG. 6A shows a detail of the integral flexible body of spout 3 of FIG. 1. The integral body can have the same thickness. However it is possible to manufacture the spout 3 having different thickness. E.g. connection 44 can be less thick, providing extra flexibility at the location. This would lower the force necessary to flex or pivot the spout opening with respect to the housing.

Figure 6B:
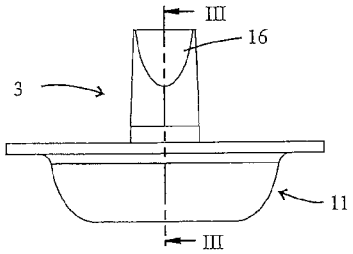
Figure 6C:
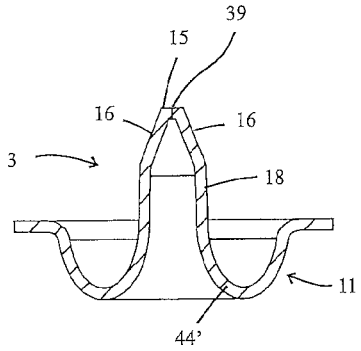

FIGS. 6B and 6C (which shows a cross section along II-III in FIG. 6B) show another embodiment of a spout 3. Here connection 44 is replaced by a bellow 44'. This increases the flexibility of the spout stem and increases the pivoting possibilities of the spout opening 39.

Figure 7:
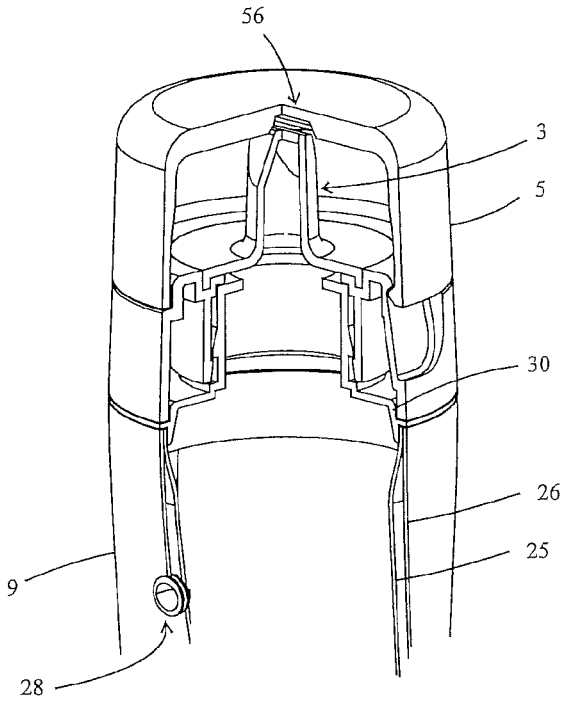
FIG. 7 shows an embodiment of a container with a dispensing system according to the invention.

FIG. 7 shows an embodiment of the application and dispensing system on a squeezable container 9. In the squeezable container 9 an internal container embodied by a pouch 25 is received. The discharge end 30 of the pouch 25 is connected to the dispensing system 1. Fluid is received in pouch 25. The exterior surface of the squeezable container is made from a memory material that will take on its original form after being squeezed. Container 9 has a valve 28 that allows the inflow of air into the space between pouch 25 and container wall 26.

In the shown embodiment the dispensing system 1 comprises the overcap 5 and spout 3. The housing 4 is shaped to correspond in this embodiment with the external dimensions of the container 9.

The overcap 5 is shaped to conform with the shoulder of the container. The overcap 5 can have recess 56 for the spout 3.

Figure 8A:
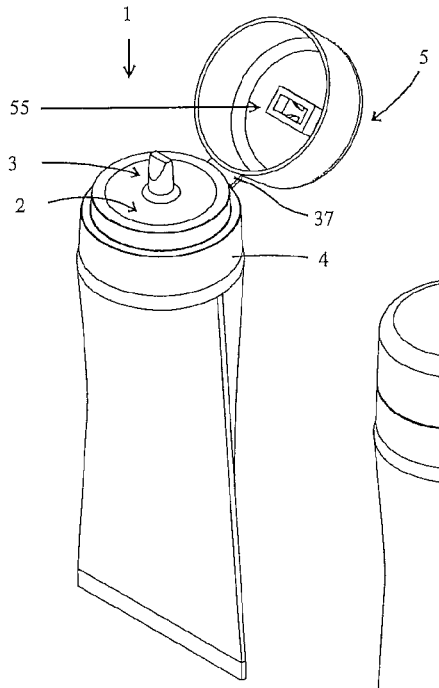
FIGS. 8A-8C show an embodiment of container and dispensing system with overcap.
Figure 8B:
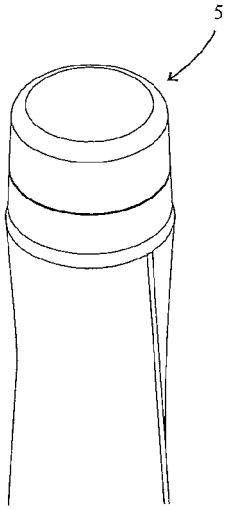
Figure 8C:
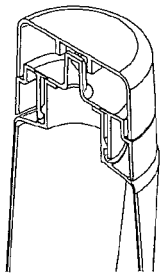

FIGS. 8*a*-8*c* show a overcap 5 that is connected to the housing 4 of dispensing system 1 via a hinge 37. The overcap can be opened, FIG. 8*a*. The overcap can be closed, FIG. 8*b*. A blocking device 55 is provided on the inside of overcap 55. In this embodiment housing 4, overcap 5 and hinge 37 can be manufactured integrally.

Figure 9A:
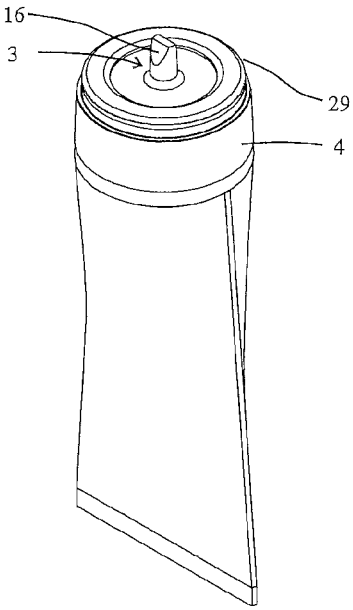
FIGS. 9A-9C show another embodiment of container and dispensing system with overcap.
Figure 9B:
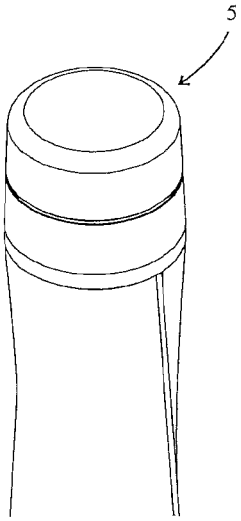
Figure 9C:
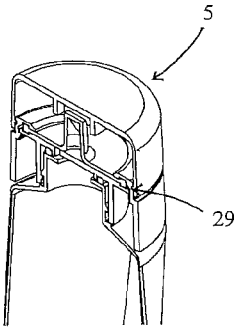

FIGS. 9*a*-9*c* show an overcap 5 that is separate from the housing 4. A snap-on or click connection 29 allows positioning the overcap 5 onto the housing 4.

Figure 10:
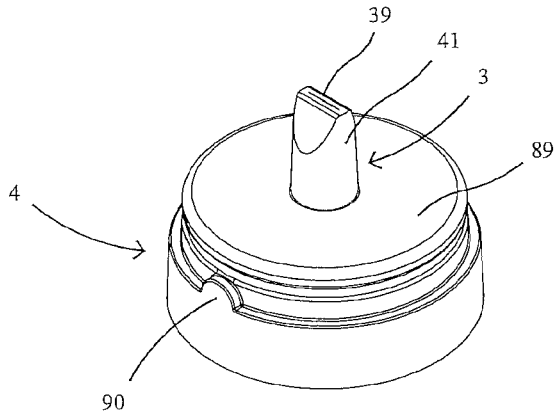
FIG. 10 shows a further embodiment of a dispensing system according to the invention.

FIG. 10 provides a view of a housing 4 provided with a configuration tab 90 that is arranged to allow connecting the overcap 5 in a predetermined, preferably one or two, positions with respect to each other. The overcap can have a receiving cavity for tab 90. This allows positioning the blocking device 55 with respect to the spout 3 in an aligned manner.

Other embodiments provide for a threaded connection between overcap 5 and housing 4 or a bayonet connection.

FIG. 10 also shows a spout 3 extending from top surface 89 of housing 4. Although this is a less preferred embodiment, the spout opening 39 can still pivot or tilt with respect to the housing, since spout 3 and especially spout stem 41 are made from a flexible material.

Figure 11:
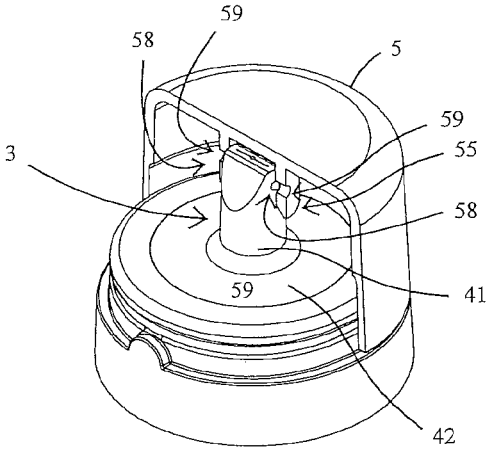
FIG. 11 shows a dispensing system having an embodiment of an air inlet system according to other aspects of the disclosed inventions herein.

FIG. 11 shows a further embodiment, wherein the spout 3 has notches 58 on spout stem 41. The blocking device 55 of the overcap 5 has openings 59 corresponding to the notches 58. If the overcap is snapped on the container, the notches 58 and openings 59 are aligned. When the overcap 5 is positioned onto the housing or when the overcap 5 is being removed, the notches 58 and openings 59 will be disaligned. The notches 58 will be pushed towards each other, resulting in a force on the spout and on the spout opening 39 that will open the spout opening 39. The opening will be for a brief moment. During this time period air can enter the spout opening 39 and enter the container 9. During that period the container 'grasps for air', taking in air, e.g. as a result of an under pressure in the container due to the container being biased to its default position by the container walls. The notches 58 and openings 59 combination are an example of a air inlet device for an airless dispensing system to allow inflow of air despite the spout opening being airless. Such an air inlet device can be also be used in combination with a spout opening having a second state in which the spout opening is not completely closed. The air inlet device then allows to let air in even in situation when the user covers the spout very quickly after use. In such cases the air inlet device will open the spout opening briefly. After the brief period, preferably the block device 55 closes the spout opening to prevent air inlet.

In further embodiments an extra air inlet valve can be provided on the dispensing system, e.g. on the housing 4 or on the spout flange 42, to allow the inflow of air into the container, despite the spout opening being embodied as an airless valve.

Figure 12:
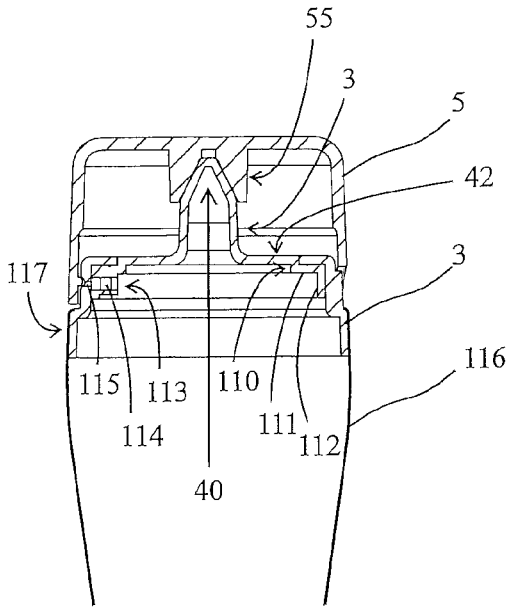
FIG. 12 shows an embodiment having an additional air inlet valve.

FIG. 12 shows in cross section an embodiment having a spout 3 having a flange 42, which at an edge thereof has a first annular wall 110 and a further flange 111, which also has an annular wall 112. Annular wall 112 is provided with a valve 113, formed during molding of the spout 3. It is a further integral part of the spout 3. In other embodiments a separate valve is positioned in the opening 114. The opening 114 is aligned with an opening 115 in the housing 3. Openings 114,115 cooperate to form an air inlet. The air inlet is positioned at a distance from the dispensing end 40. This prevents the formation of air bubbles in fluid close to the spout opening.

In embodiments the openings 114,115 could be covered by a blocking device 55 mounted on the overcap 5, when the overcap is positioned over the housing, thereby blocking the air inlet through openings 114,115 when the overcap 5 is positioned on the housing 4.

FIG. 12 is an example of a shoulderless container with the dispensing system integrally formed together with the dispensing system. The container wall 116 is sealed to an outer surface 117 of housing 3. Overcap 5 comprises blocking device 55 that engages the dispensing end of spout 3.

FIG. 13*a* shows a dispensing system 1 having a spout 3 having an additional air inlet 120 positioned in the flange 42. FIG. 13*b* shows a detail of the air inlet valve 120 in cross section. Valve 120 is formed integrally with the spout 3.

In an embodiment the spout body 3 comprises the valve 121 and in another embodiment the spout body comprises an opening in which a separate valve member is positioned. An air inlet valve separate from the spout opening/dispensing end is beneficial if the spout opening in the second state is an airless configuration. In such configuration air entry into the spout opening is prevented, resulting in less sputtering of fluid during dispensing. Air enters the fluid at a position removed from the dispensing end 40.

An radial edge 122 of flange 42 is received in a slit between housing parts 123,124.

In further embodiments the air inlet is connected to a tube that extends into the container towards the bottom of the container. This will allow the air that flows into the container to be at the bottom. Fluid will remain present near the discharge end/spout. During application, fluid will exit the spout, while the air flows into the container directly close to the bottom without disturbing the fluid present directly upstream from the spout opening or discharge end.

FIGS. 14*a*-14*c* show a further embodiment of spout and overcap. FIG. 14*a* shows a partially opened three dimensional view of a spout 220 and overcap 221. The spout end having the valve is received in a recess in the overcap 221. The spout end has an air opening. The overcap has, as a further element of the blocking device for preventing leakage of fluid from the spout, on top of the recess a notch 222 that is positioned such that the notch 222 will be received in the opening of the spout valve when the overcap is positioned over the spout. The cross sectional view of FIG. 14*c* shows more clearly the notch 222. The notch is rounded. This will easy positioning the notch in the opening, e.g. in combination with a flip-top overcap.

Recess 223 is shaped as a slit extending in a direction in and out of the paper of the cross sectional view of FIG. 14*b*. Shown in FIG. 14*b* is that wall parts 223*b* of the deeper part of the recess 223 are more acute than walls parts 223*a* closer to the opening of the recess. The spout end will be received between the wall parts and especially wall parts 223*b* will provide a squeezing force on the spout opening, preventing undesired opening thereof. The spout end is slightly overdimensioned with respect to the wall parts 223*b*. This too is visible in FIG. 14*b*, wherein the spout is slightly wider than the recess.

In further embodiments the blocking device, an in particular the recess, can be provided with a layer of a softer material, such as a resilient plastic. Such a layer or coating of resilient material. A silicon or a rubbery material can be used as layer/coating on the recess. Such a resilient material will close the opening in the spout further preventing leakage. Whereas without a fluid layer leakage can be prevented e.g. up to pressures of 2 bar without the layer/coating, with the layer/coating higher pressures can be resisted, improving leakage prevention properties. In particular leakage of the opening in the spout is prevented.

Clearly many embodiments are possible within the scope of the invention. Many of the features disclosed herein can be combined to obtain embodiments not explicitly disclosed herein. The invention is not limited to the explicitly disclosed combinations.

Further aspects are disclosed in below clauses. These clauses can be combined with any of the disclosed features in the this application.

A. Dispensing system comprising a spout, a spout opening in a spout dispensing end, biasing means for generally closing the spout opening, a coupling device and a pouch. The coupling device couples the spout with the pouch, e.g. onto the discharge end of the pouch.

B. Dispensing system for a squeezable container comprising a spout opening having a first open and a second closed airless state, wherein the dispensing system also comprises an air inlet device. This dispensing system is arranged as an airless container system, with the benefits thereof, such as ease to clean, not cluttering of fluid on the spout opening etc., but air can still enter as a result of the air inlet device. The air inlet device can be an opening 38 in the spout dispensing end. However preferably the air inlet device is not provided on the dispensing end, e.g. on the spout flange or on the housing. More preferably a separate valve is used. Even more preferably the air inlet device is connected to a tube that allows the air to enter closer to the bottom of the container.

C. Dispensing system for a squeezable fluid container arranged to receive fluid from a discharge end of the squeezable fluid container and to dispense the fluid from a dispensing end, the dispensing system comprising (1) a housing having a base that can be connected to the discharge end of the squeezable fluid container, (2) as the dispensing end, a spout having a spout opening, wherein in a first state fluid can be dispensed through the spout opening and wherein in a second state fluid discharge through the spout opening is generally blocked and (3) biasing means arranged to bias the spout to the second state, wherein the spout opening in the dispensing end comprises an air inlet hole as air inlet into the container and wherein the spout and/or an overcap provide a blocking device arranged to close the air inlet hole when the overcap is positioned over the dispensing end.

D. Dispensing system for a squeezable fluid container arranged to receive fluid from a discharge end of the squeezable fluid container and to dispense the fluid from a dispensing end, the dispensing system comprising (1) a housing having a base that can be connected to the discharge end of the squeezable fluid container, (2) as the dispensing end, a spout having a spout opening, wherein in a first state fluid can be dispensed through the spout opening and wherein in a second state fluid discharge through the spout opening is generally blocked and (3) biasing means arranged to bias the spout to the second state, wherein the dispensing system further comprises an overcap to be positioned over the spout and dispensing end, wherein the overcap/spout have a blocking device that is arranged to engage the spout and that is arranged to (at least briefly) transfer the spout opening to the first state when the overcap is positioned over the spout, to (temporarily) allow the inflow of air into the container.

E. Dispensing system for a squeezable fluid container arranged to receive fluid from a discharge end of the squeezable fluid container and to dispense the fluid from a dispensing end, the dispensing system comprising (1) a housing having a base that can be connected to the discharge end of the squeezable fluid container, (2) as the dispensing end, a spout having a spout opening, wherein in a first state fluid can be dispensed through the spout opening and wherein in a second state fluid discharge through the spout opening is generally blocked and (3) biasing means arranged to bias the spout to the second state, wherein the spout opening in the dispensing end comprises an air inlet hole as air inlet into the container and wherein the spout and/or overcap provide a blocking device arranged to close the air inlet hole when the overcap is positioned over the dispensing end.

F. Method for forming a spout, a dispensing system or a container having a dispensing system, the method comprising forming at least the spout for the dispensing system by injection molding; forming a spout opening in the spout.

Any combination of the above clauses can be combined with any of the features disclosed in the appended claims.

Dispensing system according to any of the appended claims, wherein the dispensing system comprises assembled injection molding components.

The invention claimed is:

1. A dispensing and application system suitable for a squeezable fluid container, wherein the dispensing and application system is arranged to receive fluid from a discharge end of the squeezable fluid container and to dispense the fluid from a dispensing and application end, the dispensing and application system comprising:

a housing having a base that is arranged to be connectable to the discharge end of the squeezable fluid container;

a spout that forms the dispensing and application end and comprises a spout opening, wherein the spout extends from the housing towards the dispensing and application end, wherein in a first state fluid can be dispensed through the spout opening and wherein in a second state fluid discharge through the spout opening is generally blocked; and biasing means arranged to bias the spout to the second state;

wherein, in use, the dispensing and application end is movable with respect to the housing, wherein in the second state, the spout opening is positioned at a distance of at least 1 cm from the housing in a dispensing direction, wherein the dispensing and application system further comprises a dispensing end position biasing means arranged to allow the dispensing and application end to move in a direction sideward of the dispensing direction in both the first and second state by at least 0.2 cm, and wherein the dispensing end position biasing means is arranged to bias the dispensing and application end to a default position with respect to the housing.

2. The dispensing and application system according to claim 1, wherein the spout is elastic and comprises the dispensing end position biasing means and/or wherein the dispensing end position biasing means comprise engaging means engaging the spout and the housing.

3. The dispensing and application system according to claim 1, wherein the spout has a spout stem connecting a spout base of the spout with the spout opening, the spout base engaged by the housing, or wherein the spout, the spout stem, or the spout base is flexible.

4. The dispensing and application system according to claim 1, wherein the spout comprises an integral flexible body having:

the spout opening; or the biasing means; or a hollow spout stem, which hollow spout stem has a cylindrical or frustoconical interior and/or exterior; or a spout base; or wherein the spout base comprises a flange; or wherein the spout comprises a flange, the flange being engaged by the housing, wherein the flange is arranged as a diaphragm arranged to allow the spout opening to move in a direction of the dispensing and application end.

5. The dispensing and application system according to claim 1, wherein the housing comprises a fluid receiving space in the housing to receive fluid from the squeezable fluid container and to transfer the fluid to the spout; or wherein the housing has a generally cylindrical outside shape; or wherein the fluid receiving space in the housing has a generally oval shape in cross-section.

6. The dispensing and application system according to claim 1, wherein in the first state the spout opening is opened and in the second state the spout opening is less opened; or wherein a valve is positioned in the spout opening having the first and second state; or wherein the biasing means are arranged to allow transition from a second to the first state to permit flow through the spout opening in response to a pressure differential across said spout opening; or wherein the spout opening is closed when the pressure on an interior of the container is substantially the same as the pressure on the exterior of the valve.

7. The dispensing and application system according to claim 1, further comprising a squeezable container having a discharge opening and wherein the dispensing and application system is a dispensing closure, and wherein the housing and the squeezable container are integrally formed; or wherein the housing is separate from, but releasably attachable by connection means to, said squeezable container around the discharge opening of the squeezable container; or wherein the squeezable container and/or the housing comprise connection means that have a threaded segment; or wherein the squeezable container and/or the housing comprise connection means that have a snap fit arrangement to engage or to be engaged by a portion of the squeezable container.

8. The dispensing and application system according to claim 1, wherein the dispensing and application system further includes an overcap, wherein the overcap is removable; or wherein the overcap is connected over a hinge connection to the housing; or wherein the overcap and spout cooperate to at least support the spout in the second state; or wherein the overcap comprises a blocking device for engaging and closing the spout opening; or wherein the overcap and spout cooperate to block movement of the spout opening in the dispensing end direction.

9. The dispensing and application system according to claim 1, wherein the dispensing and application end is arranged to at least pivot with respect to the housing.

10. The dispensing and application system according to claim 9, wherein the dispensing and application end of the spout is formed by the most distal end of the spout having an application strip having the spout opening extending over that strip.

11. The dispensing and application system according to claim 9, wherein the spout opening pivots along an arc that extends in a direction perpendicular to a dispensing end direction; or wherein the spout is arranged to flex; or wherein the spout opening is arranged to pivot perpendicular to direction of application of the fluid from the spout opening.

12. The dispensing and application system according to claim 1, wherein a connection between spout and housing is arranged to allow moving the spout opening at least in a direction parallel to the dispensing direction.

13. The dispensing and application system according to claim 12, wherein the spout comprises an integral flexible body having the spout opening and a spout flange that is engaged by the housing forming a diaphragm; and/or wherein the spout opening can move at least 0.1 cm in a direction parallel to the dispensing direction.

14. The dispensing and application system according to claim 1, wherein, in use, the dispensing and application end is arranged to pivot with respect to the housing in a direction contrary to an application direction.

15. A squeezable container comprising a dispensing and application system according to claim 1, wherein the squeezable container comprises a pouch; or wherein the dispensing and application system is airless; or wherein the squeezable container comprises a valve for allowing air to enter the squeezable container.

16. A method for forming a dispensing and application system according to claim 1, said method comprising:

forming at least the spout for the dispensing and application system by injection molding;

forming the spout opening in the spout by cutting an opening;

assembling the spout and other components to form the dispensing and application system.

17. A spout for a dispensing and application system arranged to be mounted on a squeezable container, the spout comprising a spout opening for dispensing a fluid, wherein the spout comprises an integrally formed flexible body having:

the spout opening on a dispensing and application end;

a spout base comprising a fluid receiving opening; and a hollow spout stem connecting the dispensing and application end to the spout base;

wherein the spout is arranged such that the flexibility of the integrally formed body allows the dispensing and application end to move in a direction sideward of a dispensing direction by at least 0.2 cm, and wherein the spout opening is positioned at a distance of at least 1 cm from the spout base.

18. The spout according to claim 17, wherein the spout base has a flange arranged to function as a diaphragm when mounted on a housing of the dispensing and application system.

19. The spout according to claim 17, wherein the spout opening has a first state in which fluid can be dispensed and a second state wherein fluid dispensing is generally blocked.

20. The spout according to claim 17, wherein the dispensing end has an application strip forming a distal end and forming an applicator surface, in which the spout opening is formed.

* * * * *